US008050606B2

(12) United States Patent
Inada

(10) Patent No.: US 8,050,606 B2
(45) Date of Patent: Nov. 1, 2011

(54) MATERIAL FOR REMOVING RESIDUE TONER

(75) Inventor: Kazuhide Inada, Itami (JP)

(73) Assignee: Fuji Corporation, Hyogo (JP)

( * ) Notice: Subject to any disclaimer, the term of this patent is extended or adjusted under 35 U.S.C. 154(b) by 1609 days.

(21) Appl. No.: 11/398,871

(22) Filed: Apr. 6, 2006

(65) Prior Publication Data

US 2006/0233574 A1 Oct. 19, 2006

(30) Foreign Application Priority Data

Apr. 15, 2005 (JP) ..... 2005-002332 U

(51) Int. Cl.
*G03G 15/20* (2006.01)
*G03G 21/00* (2006.01)
*D04H 1/08* (2006.01)

(52) U.S. Cl. ..... 399/327; 399/353; 442/324

(58) Field of Classification Search ..... 399/327, 399/353; 430/119.8, 119.86; 428/36.1; 442/324, 442/394, 402
See application file for complete search history.

(56) References Cited

U.S. PATENT DOCUMENTS 5,576,815 A * 11/1996 Teschendorf et al. ..... 399/249
5,649,130 A * 7/1997 Nakajima et al. ..... 399/327
6,156,681 A * 12/2000 Tamaru et al. ..... 442/383

FOREIGN PATENT DOCUMENTS

JP 10-116011 5/1998
JP 2001-312172 11/2001

OTHER PUBLICATIONS

Machine translation of JP 2001-312172A.*

* cited by examiner

*Primary Examiner* — David Gray
*Assistant Examiner* — Gregory H Curran
(74) *Attorney, Agent, or Firm* — Kirschstein et al.

(57) ABSTRACT

A material for removing residue toner has a non-woven felt with excellent oil retentivity, cleaning, and dry heat-stability, which is disposed on an oiled belt, an oiled roller or an oiled pad for a fixing machine or the like in a photographic imaging process. The material is composed of the felt in which carded lap is milled by punching with needle, the carded lap being consisted mainly of one or more heat-resistant organic fibers whose cross section has an acute angle. The felt is attached adhesively on a body of an acting member and comes into contact with the surface of an operating member such as a fixing roller or a developing roller.

8 Claims, 3 Drawing Sheets

MATERIAL FOR REMOVING RESIDUE TONER

FIELD OF THE INVENTION

The present invention relates to a material for removing residue toner from the surface of an operating member, which is disposed for a photographic imaging process or the like. More particularly, the present invention relates to a non-woven felt having excellent oil retentivity, cleaning and dry heat stability, said felt being attached on an oiled belt, an oiled roller, an oiled pad for use primarily in a fixing machine or the like.

DESCRIPTION OF PRIOR ART

In a photographic imaging process such as electronic copying machines and laser printers, the surroundings of a fixing machine is usually in environment of high temperature of 180-200° C., and the temperature thereof temporarily reaches 220-230° C. during starting of the machine. As for the fixing machine, therefore, a non-woven felt made out of a PTFE (polytetrafluoroethylene) fiber, a meta-aramid fiber (poly-m-phenyleneisophthalamide) or the like having excellent heat-resistance is generally used for a peripheral equipment like an oiled belt and a cleaning roller.

The non-woven felt made out of a PTFE fiber has already been used widely for a developing machine in a photographic imaging process to prevent toner flowing out. The felt for the developing machine was disclosed variously, for example, in Japanese Open Publication No. 61-129664, Japanese Open Publication No. 04-134374 and Japanese Utility Model No. 2537613. Since the PTFE fiber has excellent heat resistance, small frictional resistance and high elasticity, it is suitable for the fixing or the developing machine as a non-woven material for removing residual toner.

AS for the photographic imaging process, the felt made out of a PTFE fiber was insufficient to remove waste toner, in other words, cleaning property though it had an enough performance in the point of heat resistance, frictional resistance and elasticity when it was used around the fixing machine. A conventional PTFE fiber was manufactured by mixing dispersion solution of PTFE particulate with small quantity of a matrix material, extruding the mixed solution into a spinning solution in which the matrix material is coagulated to form a fiber, and removing the matrix material from the fiber by thermal decomposition of the matrix material. Accordingly, the cross section of the PTFE fiber is almost a circle as well as that of spinneret holes and the circumference of the PTFE fiber is smooth as a whole. When a non-woven felt made out of the PTFE fiber comes into contact with a fixing roller, it is liable to slip on the surface of the fixing roller on which residue or waste toner is attached and thus the PTFE fiber lowers the function for scraping waste toner off the fixing roller. About a non-woven felt made out of a meta-aramid fiber, also, the same problem as the PTFE fiber occurs because the circumference thereof is also smooth as a whole.

So as to attempt reduction in the production cost of the non-woven felt, other inexpensive organic fiber and/or inorganic fiber was mixed with the PTFE fiber or the meta-aramid fiber. The thus obtained non-woven felt decreased heat stability or oil-retentivity, and that remained the same problem as the above-mentioned. The non-woven felt was not suitable as members around the fixing machine.

SUMMARY OF THE INVENTION

It is an object of the present invention to provide a material for removing residue toner from the surface of an operating member in a fixing machine or the like, on which non-woven felt with excellent cleaning property and oil retentivity is arranged.

It is another object of the present invention to provide a material having a felt for an oiled belt, which rubs and removes residue waste toner from the surface of an operating member effectively.

It is a further object of the present invention to provide a material having a felt for an oiled roller, which rubs and removes residue waste toner from the surface of an operating member effectively.

It is yet a further object of the present invention to provide a material having a felt for an oiled pad, which rubs and removes residue waste toner from the surface of an operating member effectively.

It is yet a further object of the present invention to provide a material having a felt for a cleaning roller, which rubs and removes residue waste toner from the surface of an operating member effectively.

It is yet a further object of the present invention to provide a material having a felt for a cleaning pad, which rubs and removes residue waste toner from the surface of an operating member effectively.

The material for removing residue toner according to the present invention is composed of a non-woven felt in which carded lap is milled by punching with needle, the carded lap being consisted mainly of a heat-resistant organic fiber whose cross section has an acute angle. The non-woven felt is adhesively attached on a body of an acting member such as an oiled belt, an oiled roller, a cleaning roller, a cleaning pad or an oiled pad to bring the felt into contact with the surface of an operating member such as a fixing roller inside a fixing machine, a transferring roller, a photoconductor drum or a developing roller. The non-woven felt comprises the heat-resistant organic fiber produced by a film-splitting method or a fiber-dividing method and whose cross section has an acute angle. The heat-resistant organic fiber consists mainly of a PTFE fiber, at least one fluorocarbon fiber except the PTFE fiber, a polyimide fiber or an aramid fiber, which is manufactured by the film-splitting method. Especially, the heat-resistant organic fiber is preferably the PTFE fiber manufactured by the film-splitting method. An additional fiber produced by the fiber-dividing method may be mixed with the main fiber produced by the film-splitting method to such an extent that physical property of the main fiber is not degraded. The additional fiber may be made out of a dividable composite fiber comprising a polypropylene/nylon fiber, a polyester/polypropylene fiber, a polyester/polyethylene/ polypropylene fiber or a polyester/nylon/polypropylene fiber.

The felt member made out of the heat-resistant organic fiber may be used for an oiled belt for the fixing machine. These felt members are mounted on the circumference of a couple of core rollers disposed horizontally at regular intervals, respectively. The both side edges of the felt member are brought into contact with the upper circumference of the core rollers.

The felt member made out of the heat-resistant organic fiber may be also used for an oiled or a cleaning roller for the fixing machine. This felt member is wrapped closely on the circumference of a core roller. The felt member is brought into contact with the circumference of the fixing roller.

The felt member made out of the heat-resistant organic fiber may be also used for an oiled or a cleaning pad for the fixing machine. This felt member is entirely bonded to a plastic base and brought into contact with the circumference of the fixing roller.

The material according to the present invention comprises the non-woven felt consisted mainly of the heat-resistant fiber whose cross section has an acute angle, which may be disposed on an electronic copying machine and a laser printer in a photographic imaging process. When the material of the present invention is brought into contact with the surface of the operating member on which residue waste toner is attached, it has an excellent effect on rubbing and removing the waste toner from the surface of the operating member because a cross section of the felt fiber has an acute angle. Accordingly, the material of the present invention is about the same in a unit price as compared with a conventional felt made of a normal PTFE fiber or a meta-aramid fiber only but is much advantageous in physical properties, on a peripheral member for an electronic copying machine or a laser printer.

The material of the present invention may be used as an oiled belt, roller or pad by impregnating silicone oil or fluorocarbon oil in a predetermined volume. The material of the present invention does not cause spillage and shortage of oil even in a simple composition. By coating and supplying an acting member with oil in the surroundings of high temperature, the material of the present invention does not lead mechanical parts to thermal seizing by spillage or shortage of oil in a heating facilities including the fixing machine and thus stable mechanical operation of the heating facilities can be continued. The material of the present invention is also low friction when the non-woven felt is made of the PTFE fiber manufactured by the film-splitting method, and is excellent in thermal stability, an oil retentivity, an oil-supply capacity and a cleaning property.

DETAILED DESCRIPTION OF THE INVENTION

Figure 1:
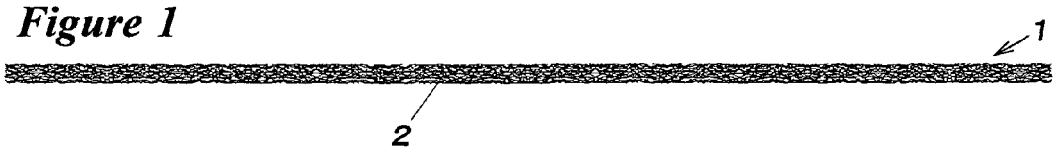
FIG. 1 is a schematic cross-section illustrating a felt used in the present invention.

Relating to a felt 1 (FIG. 1) used for a material for removing residue toner according to the present invention, it is manufactured from carded lap made out of a heat-resistant organic fiber 2 produced by a film-splitting method or a fiber-dividing method. The carded lap is milled by needle-punching to obtain the felt 1 having a predetermined thickness and density by heat treatment. In this felting, a high-pressure water-jet treatment or a resin finishing with a fluorocarbon resin such as FEP (tetrafluoroethylene hexafluoropropylene copolymer) resin may be carried out after the needle-punching, this resin finishing being, for instance, a surface-coating or impregnating treatment. If desired, a ground fabric 4 of a heat-resistant organic fiber may be put between bisecting carded laps 3 and 3 as shown in FIG. 2 or under single carded lap.

In the case where the felt 1 is arranged around the material for rubbing residue toner inside a fixing machine whose inside temperature reaches 180-230° C., the heat-resistant organic fiber 2 composing the felt is preferably a PTFE fiber or other fluorine fibers, a polyimide fiber and/or an aramid fiber which manufactured by a film-splitting method, especially preferably a PTFE fiber. It is possible to add at least one heat-resistant organic fiber manufactured by a dividing method and other inorganic or organic fibers and to blend it with the heat-resistant fiber 2 to such an extent that physical properties of the heat-resistant fiber 2 is not degraded. The mixture amount thereof is generally less than 50%. The felt 1 composed of these fibers is excellent in a thermal stability, an oil-retentivity, a cleaning property and the like.

On the film-splitting method, a thin membrane 5 manufactured by a melt membrane-making method or the like is cut into fibers with a micro slitter, the fibers being drawn and treated with heating according to circumstances, to obtain the organic fiber 2 whose cross section is rectangular in shape. In the case of PTFE fiber, PTFE paste in which a supplementary agent such as petroleum agent is added to PTFE resin particulates is formed into a rawish tape-shaped membrane 5 with an extrusion-molding machine. The thin membrane 5 is cut into fibers with a micro slitter and then the fibers are drawn and treated with heating. The cross section of the PTFE fiber thus obtained is rectangular in shape. The organic fiber 2 produced by the film-splitting method has the form of an ultra fine tape, fineness thereof is more than 1 decitex and cross section thereof has an acute angle. The PTFE fiber produced by the film-splitting method is a white color as compared with brown fibers produced by an emulsion-spinning method.

On the other hand, the additional fiber manufactured by the fiber-dividing method is a composite fiber 6 (FIG. 4 and FIG. 5) of multi-component that consists of at least two and more fiber-forming resins of non-compatibility before dividing. Two and more resins are formed and integrated into a given shape of a raw fiber through a guide or passage in a nozzle plate and the raw fiber is extruded from the spinning nozzle, solidified and then wound up to obtain the composite fiber 6. The composite fiber 6 is, for instance, a binary hollow fiber (FIG. 4) or radial-shaped fiber (FIG. 5) having one thermoplastic resin portion 7 of polyester and another thermoplastic resin portion 8 of nylon. The thermoplastic resin portions 7, 8 turn into mixed heat-resistant fibers of polyester and nylon by dividing.

About the dividable composite fiber 6, a polyester/nylon fiber, a polyester/polypropylene fiber, a polyester/polyethylene/polypropylene fiber or a polyester/nylon/polypropylene fiber may be exemplified as a combination with thermoplastic resin portions 7 and 8. For instance, the polyester/nylon fiber is suitable for the composite fiber 6. Besides these combinations, one or more optional combinations can be adopted.

Figure 4:
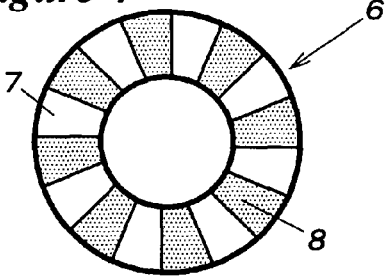
FIG. 4 is an enlarged end elevation showing an example of a dividable hollow composite fiber.
Figure 5:
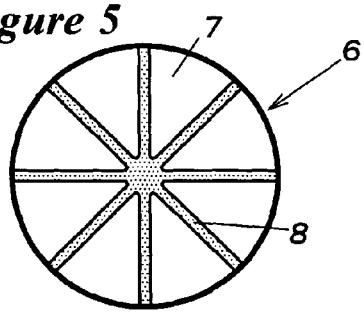
FIG. 5 is an enlarged end elevation showing an example of a dividable radial composite fiber.

The composite fiber 6 is dividable by a mechanical process such as needle-punching, a heating process or the chemical treatment with the solvent. As a result of this treatment, the composite fiber 6 is divided into fibers along given longitudinal contact lines to get 8, 16, 24 or more pieces of fiber. Fineness per a piece of the fibers after dividing is preferably 0.1-0.5 decitex. The divided fiber may be so formed that a cross section thereof has an acute angle, for example, the cross section thereof being not only like a sector in shape as shown in FIG. 4, but also a nearly triangular in shape as shown in FIG. 5.

In the material of the present invention, the felt 1 may be composed mainly of one or more heat-resistant divided fibers and may include partially one or more conventional divided fibers. In the case where conventional divided fibers are partially included, it is preferably to mount the material of the present invention on a relatively low temperature location inside a fixing machine, or to dispose the material of the present invention for a developing machine or the like in the lower temperature surroundings than the inside of the fixing machine with respect to a photographic imaging process. The felt composed of one or more divided fibers is excellent in oil retentivity and cleaning property. It is also possible to improve dimensional stability of the felt 1 better than ever by putting a ground fabric 4 (FIG. 2).

The material of the present invention may be mounted on a location where the felt 1 comes into contact with the surface of an operating member such as the fixing roller, a transferring roller or a developing roller or may be arranged around the operating member whose inside temperature reaches 220-230° C. during starting in the photographic imaging process. The material of the present invention may be applied to an acting member such as an oiled belt 11 (FIG. 6), oiled roller 12 (FIG. 7) or the like, in which silicone or fluorocarbon oil is impregnated in the predetermined volume before or after the installation of the felt 1. The material of the present invention may be also used as the cleaning roller 14 (FIG. 8) or the cleaning pad 15 (FIG. 9) inside the fixing or developing machine.

EXAMPLES

Though the present invention is now described on the basis of the following examples, it would not be limited to the following examples.

Example 1

Figure 2:
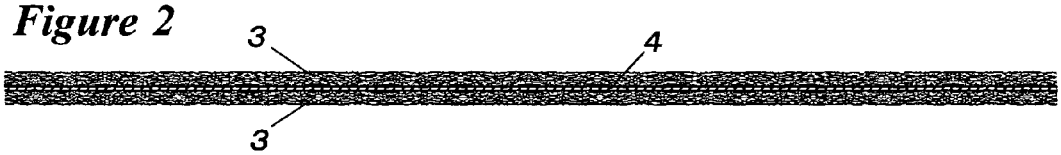
FIG. 2 is a schematic cross-section showing another embodiment of a felt.

So as to produce a felt 1 as shown in FIG. 1, a PTFE fiber was manufactured by a film-splitting method, the fiber having a rectangular cross section and average fineness of 3.3 decitex. A web was made out of 100% these PTFE fibers. The web was accumulated to form carded lap having unit weight of 400 gm/m$^2$ and then punch the entire carded lap with needle. After punching with needle, it was pressed at about 250° C. for three minutes to obtain the felt 1 having 1.0 mm. in thickness.

Figure 6:
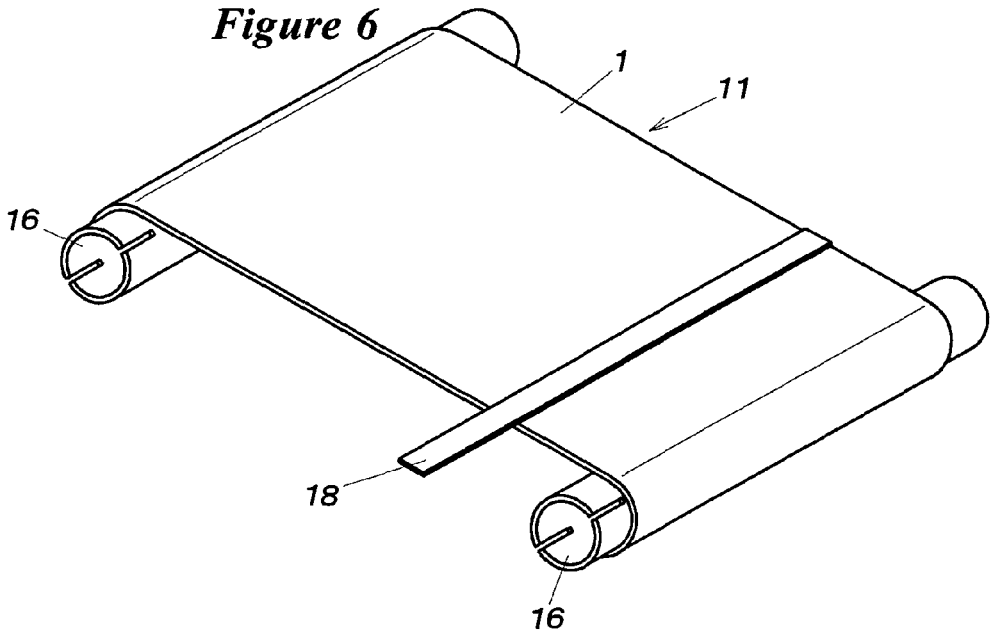
FIG. 6 is a perspective view of an oiled belt showing an embodiment of a material for removing toner.

The felt 1 was used for an oiled belt 11 as shown in FIG. 6. A couple of core rollers 16, 16 made from aluminum or bakelite was horizontally disposed at regular intervals. Both the side edges of the felt 1 were put into contact with on the upper circumference of the core rollers 16, 16 and then bonded with liquid epoxy resin. The felt 1 was kept horizontally by both of the core rollers 16, 16. A limit bar 18 was a plate having a long rectangular form. The limit bar 18 made from Duracon or epoxy resin was put into contact with on the surface of the felt 1 and then bonded with liquid epoxy resin. The limit bar 18 was arranged in parallel to a core roller 16.

After curing of the liquid epoxy resins, silicone oil was impregnated into the felt 1. The impregnation volume of silicone oil was 0.2 cc/cc. An oiled belt 11 was disposed so as to bring the felt 1 into contact with the circumference of a fixing roller in a fixing machine whose inside temperature reaches 220-230° C. during starting.

The oiled belt 11 was sufficient for a toner-removing property. A slipping property, an oil-retention and oil-supply capacities thereof were also excellent.

Example 2

Figure 3:
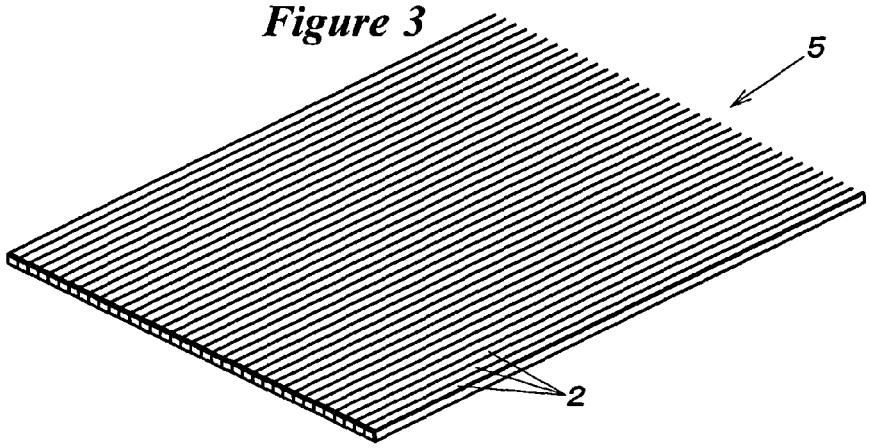
FIG. 3 is a partial perspective enlarged view showing an example of a thin membrane film that can be cut with a micro-slitter.

So as to produce a felt 1 as shown in FIG. 1, a FEP film 5 of 12.5 microns in thickness (FIG. 3) manufactured by a melt membrane-making method was cut into fibers with a micro-slitter and then drawn to obtain FEP fibers having average fineness of 20 decitex whose cross section is rectangular in shape. Carded lap of unit weight of 400 gm/m$^2$ was made out of 100% these fibers and then the entire carded lap was punched with needle. After punching with needle, it was pressed at about 230° C. for three minutes to obtain the felt 1 having 1.5 mm. in thickness.

Silicone oil was impregnated into the felt 1 to use for an oiled belt 11 as well as Example 1. The impregnation volume of silicone oil was 0.2 cc/cc. The oiled belt 11 was disposed so as to bring the felt 1 into contact with the circumference of a fixing roller in a fixing machine whose inside temperature reaches 220-230° C. during starting.

The oiled belt 11 was sufficient for a toner-removing property. An oil-retention and oil-supply capacities thereof were also excellent.

Comparison 1

A PTFE fiber produced by an emulsion-spinning method had round cross section. 100% these fibers were uniformly carded or blended together to manufacture a web. This web received the same treatment as Example 1 to obtain a felt of 1.5 mm. in thickness and unit weight of 400 gm/m$^2$.

The felt thus obtained was applied to an oiled belt as well as Example 1. Silicone oil was impregnated into the felt. The impregnation volume of silicone oil was 0.2 cc/cc. This oiled belt was relatively good for a slipping property and oil-retention capacity, but was insufficient for a toner-removing property.

When this oiled belt was arranged so as to bring the felt into contact with the circumference of a fixing roller, a part of residual toner leaked out the oiled belt.

Example 3

Figure 7:
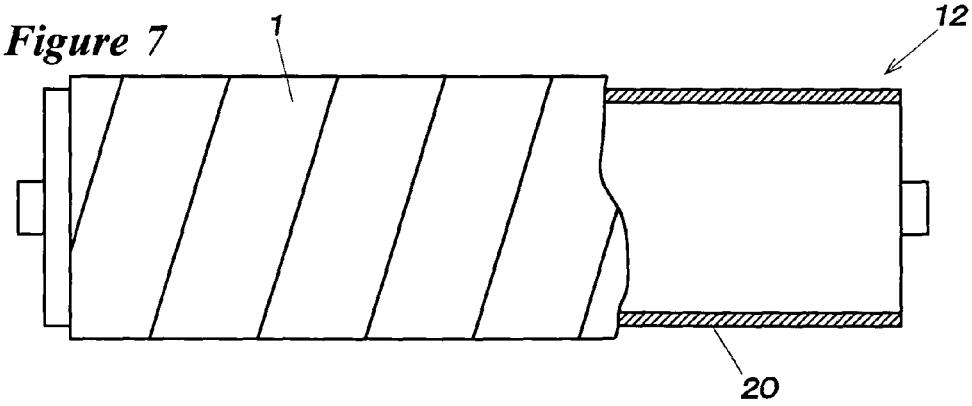
FIG. 7 is a partial sectional view of an oiled roller showing another embodiment of a material for removing toner.
Figure 8:
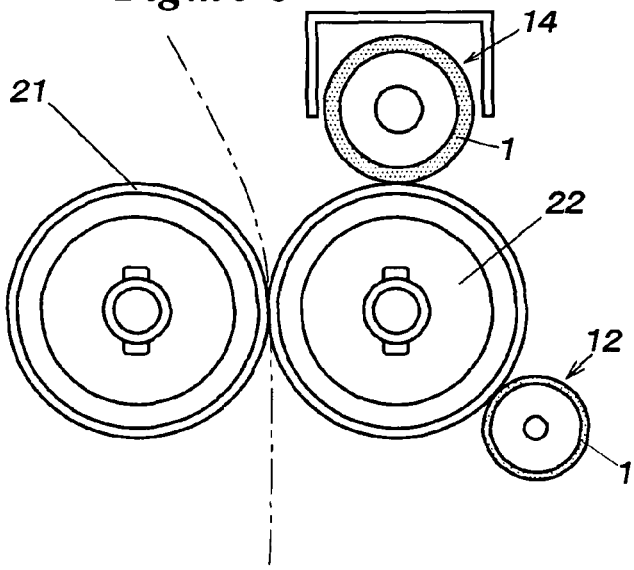
FIG. 8 is a schematic side view illustrating the installation of the oiled roller shown in FIG. 7.

The felt 1 manufactured in Example 1 was cut out to a width of 25 mm. and applied to an oiled roller 12, as shown in FIG. 7. A core roller 20 inside the oiled roller 12 was made out of aluminum. The entire circumference of the core roller 20 was coated with liquid epoxy resin. After this coating, a tape of the felt 1 was helically wrapped closely on the circumference in core roller 20. After the liquid epoxy resin cured for 24 hours, silicone oil was impregnated into the felt 1. This impregnation volume of silicone oil was 0.25 cc/cc.

The oiled roller 12 was arranged so as to bring the felt 1 into contact with the circumference of a fixing roller 22 in a fixing machine 21 whose inside temperature reaches 220-230° C. during starting.

The oiled roller 12 was sufficient for a toner-removing property. An oil-retention property and oil-supply capacity thereof were also excellent.

Example 4

A cleaning roller 14 (FIG. 8) was manufactured as well as Example 3 by means of a felt 1 of 1.0 mm. in thickness. In this case, oil was not impregnated into the roller. The cleaning roller 14 was sufficient for a toner-removing property when it was disposed so as to bring the felt 1 into contact with the circumference of a fixing roller 22.

Example 5

Figure 9:
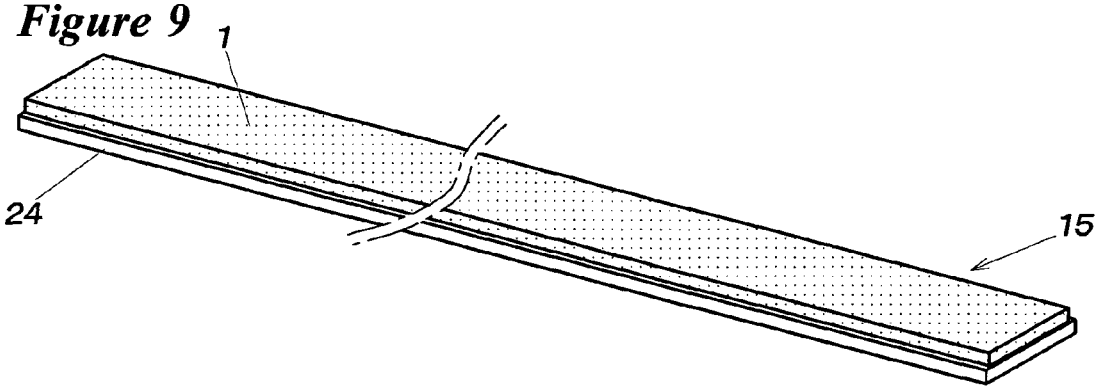
FIG. 9 is a schematic perspective view of a cleaning pad showing a further embodiment of a material for removing toner.

As shown in FIG. 9, the felt 1 manufactured in Example 1 was cut out to a width of 7 mm. and a length of 23 mm. and applied to a cleaning pad 15. A base 24 of the cleaning pad 15 was made of phenol resin. A duplicated acrylic tape was put between the pad base 15 and the felt 1 to bond them together. 0.3 cc/cc of silicone oil was impregnated into the felt 1.

The size of the felt used for the cleaning pad 15 may be the range of 5-10 mm. in width and 20-30 mm. in length. The cleaning pad 15 was arranged so as to bring the felt 1 into contact with the circumference of a fixing roller in a fixing machine whose inside temperature reaches 220-230° C. during starting. The cleaning pad 15 was sufficient for a toner-removing property.

What is claimed is:

1. A material for removing residue toner from a surface of an operating member in a photographic imaging process by bringing the material into rubbing contact with the surface of the operating member, the material comprising:

a non-woven felt milled from a needle-punched, carded lap comprised of elongated, heat-resistant, organic fiber selected from the group consisting of a polytetrafluoroethylene (PTFE) fiber and at least one fluorocarbon fiber excepting the PTFE fiber, the organic fiber being cut from a thin membrane up into filaments, the cut filaments being heat-treated such that a cross-section of a plurality of the cut filaments has at least one angled edge in rubbing contact with the surface of the operating member during residue toner removal.

2. The material according to claim 1, in which the cross-section of the cut filaments is rectangular in shape.

3. The material according to claim 1, in which the membrane is PTFE.

4. The material according to claim 1, in which the non-woven felt is attachable on a body at a low-temperature location inside a fixing machine, the body being one of an oiled belt, an oiled roller, a cleaning roller, a cleaning pad and an oiled pad.

5. The material according to claim 1, in which the non-woven felt has an outer surface for rubbing the residue toner off a surface of an operating member that is selected from the group consisting of a fixing roller inside a fixing machine, a transferring roller, a photoconductor drum, a developing roller and an electrified roller inside a developing machine.

6. The material according to claim 1, and a ground fabric within the non-woven felt.

7. The material according to claim 1, wherein the non-woven felt is a helical wrap.

8. The material according to claim 1, and an oil impregnating the non-woven felt.

* * * * *